US005512994A

United States Patent [19]

Koike

[11] Patent Number: 5,512,994

[45] Date of Patent: Apr. 30, 1996

[54] SEPARATING APPARATUS INCLUDING MESH DEVICE FOR SEPARATING RECOVERED RESIDUAL MATTER

[75] Inventor: Michiro Koike, Kawasaki, Japan

[73] Assignee: Canon Kabushiki Kaisha, Tokyo, Japan

[21] Appl. No.: 266,452

[22] Filed: Jun. 27, 1994

[30] Foreign Application Priority Data

Jun. 29, 1993 [JP] Japan ..... 5-159050

[51] Int. Cl.[6] ..... G03G 21/10

[52] U.S. Cl. ..... 355/298; 118/652

[58] Field of Search ..... 355/245, 296, 355/298; 118/652

[56] References Cited

U.S. PATENT DOCUMENTS

| | | | |
|---|---|---|---|
| 4,054,381 | 10/1977 | Bernhard | 355/298 X |
| 4,267,245 | 5/1981 | Wada | 118/652 X |
| 4,319,832 | 3/1982 | Sakamoto et al. | 118/652 X |
| 4,389,968 | 6/1983 | Satomura | 118/652 |
| 4,639,115 | 1/1987 | Lin | 118/652 X |
| 4,708,455 | 11/1987 | Kubota et al. | 355/211 |
| 4,989,047 | 1/1991 | Jugle et al. | 118/652 X |
| 5,335,051 | 8/1994 | Tani | 355/245 |

*Primary Examiner*—William J. Royer

*Attorney, Agent, or Firm*—Fitzpatrick, Cella, Harper & Scinto

[57] ABSTRACT

A separating apparatus for separating residual matter removed from an image bearing member into developer and other foreign matter comprises a first unit to which residual matter removed from the image bearing member is conveyed, a mesh member for allowing only developer to pass among the residual matter, and a second unit to which developer is conveyed through the mesh member. The first and second units are separable from each other with the mesh member intervening therebetween. The apparatus also may include a vibration applying device for applying vibration to the mesh, a convey device for conveying residual matter to the first unit, and a discharging device for discharging developer from the second unit. The apparatus further may include a first magnetic force generating device in the first unit and a second magnetic force generating device in the second unit.

13 Claims, 11 Drawing Sheets

SEPARATING APPARATUS INCLUDING MESH DEVICE FOR SEPARATING RECOVERED RESIDUAL MATTER

BACKGROUND OF THE INVENTION

1. Field of the Invention

The present invention relates to a separating apparatus for separating a mixture of developer and other foreign matters to remove the foreign matters and to an image forming apparatus using such a separating apparatus. More particularly, the present invention relates to a separating apparatus used with an image forming apparatus of the electrophotographic type, such as a copying machine, a printer and the like.

2. Related Background Art

In order to effectively utilize resources and to protect environmental conditions, there have been proposed various separating apparatuses for separating residual matter removed from an image bearing member into developer and other foreign matters, and various apparatuses wherein the separated developer is reused. Among these separating apparatuses, a separating apparatus using a mesh-shaped filter has a relatively simple construction.

However, in a separating apparatus using a mesh-shaped filter, typically the mesh of the filter is gradually clogged as the apparatus is continuously operated. It is very difficult to prevent the clogging of the filter completely.

SUMMARY OF THE INVENTION

An object of the present invention is to provide a separating apparatus and an image forming apparatus wherein, if a mesh is clogged or jammed, maintenance can easily be performed.

Another object of the present invention is to provide an image forming apparatus which can prevent formation of a poor image due to the mixing of any foreign matter with developer.

A further object of the present invention is to provide a separating apparatus and an image forming apparatus wherein developer which has been used once can be reused.

A still further object of the present invention is to provide a separating apparatus and an image forming apparatus wherein a first unit and a second unit can be separated from each other at a location of the mesh member.

Other objects and features of the present invention will be apparent from the following detailed explanation referring to the accompanying drawings.

DETAILED DESCRIPTION OF THE PREFERRED EMBODIMENTS

First Embodiment

Figure 1:
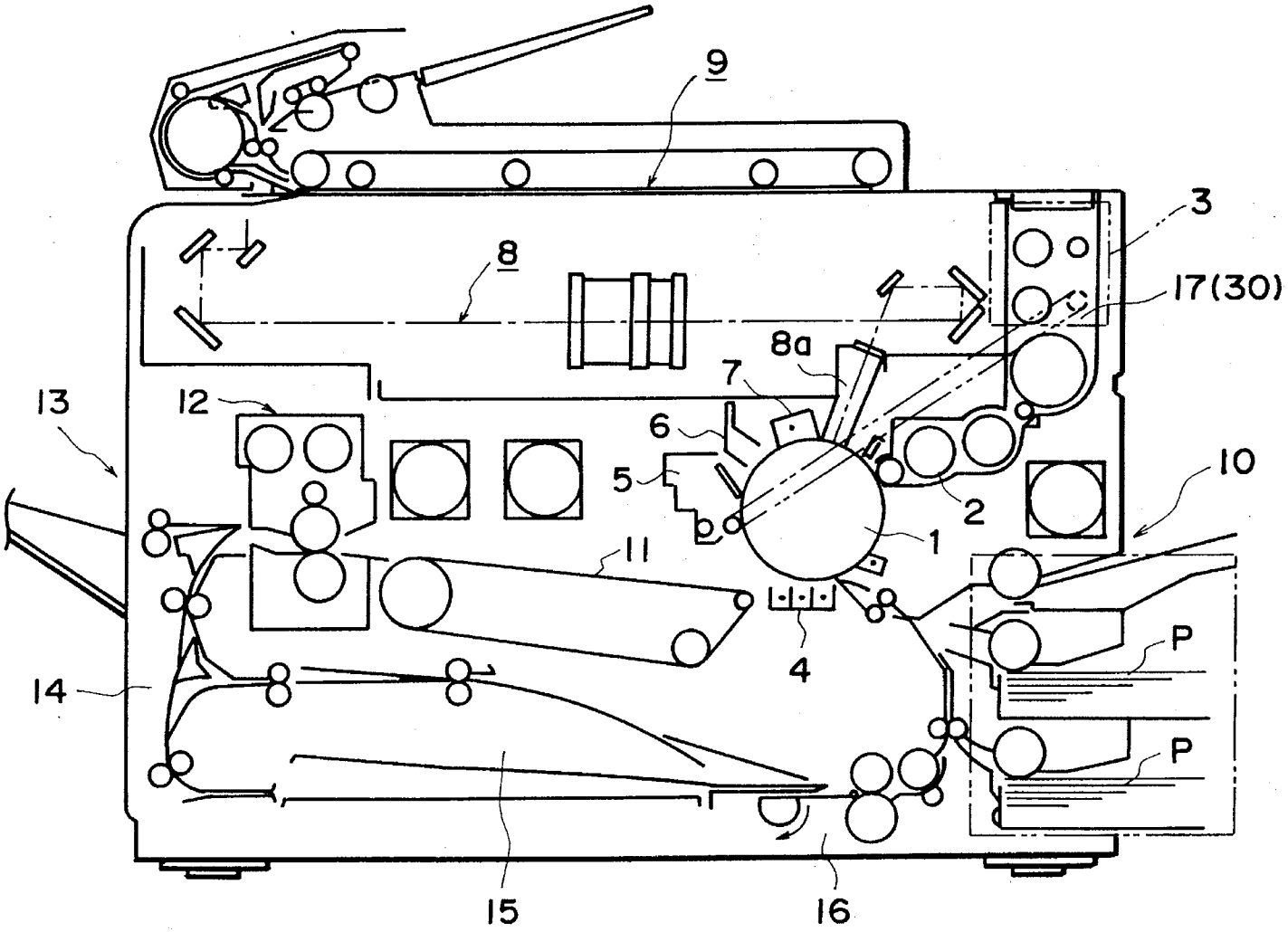
FIG. 1 is a schematic sectional view of an image forming apparatus having a separating apparatus according to the present invention.

An image forming apparatus having a separating apparatus according to a first embodiment of the present invention will be explained with reference to the accompanying drawings. FIG. 1 is a schematic sectional view of the image forming apparatus.

In FIG. 1, an image forming portion of the image forming apparatus includes an image bearing member 1, a developing device 2 for visualizing a latent image formed on the image bearing member 1 by applying developer to the latent image, a hopper portion 3 for supplying developer to the developing device 2, a transfer separation charger 4 for transferring developer visualized on the image bearing member 1 onto a sheet, a cleaning device 5 for removing developer and other foreign matter remaining on the image bearing member 1, an electric charge removal portion 6 for removing electricity charge from the image bearing member 1, a first charger 7 for uniformly charging the image bearing member 1, an optical reading system 8 for reading image information on an original, and an exposure portion 8*a* for forming the latent image on the image bearing member 1 on the basis of the image information.

The image forming apparatus further comprises an original process device 9 for directing the original to an image reading portion, a sheet supply portion 10 for supplying a sheet to the image forming portion, convey means 11, a fixing device 12 for fixing an image (developer image) transferred to a sheet at the image forming portion onto the sheet, a sheet discharge portion 13 for discharging a sheet on which an image has been formed, a re-supply sheet introduction portion 14 for re-supplying a sheet in a both-face copy mode or a multi copy mode, an intermediate tray 15 on which sheets to be re-supplied are temporarily stacked, and a sheet re-supply portion 16 for re-supplying a sheet from the intermediate tray 15 to the image forming portion.

Next, the operation of the image forming apparatus will be explained.

When a copy start button (not shown) is depressed, an original in the original process device 9 is introduced to the image forming portion, and image information on the original is read by the optical reading system 8. On the other hand, the image bearing member 1 from which electric charge has been removed by the electricity removal portion 6 is charged to a predetermined potential by the first charger 7, and the image information is written on the image bearing member 1 as a latent image in the exposure portion 8*a*. Then, the latent image formed on the image bearing member 1 is visualized by the developing device 2 by adhering developer to the latent image. In this case, when developer in the developing device 2 is reduced below a predetermined level, new developer is replenished to the developing device from the hopper portion 3.

When a sheet P is supplied from the sheet supply portion 10 to a transfer station in the image forming portion, a developed image on the image bearing member 1 is transferred onto the sheet P by the transfer separation charger 4, and the sheet on which the image has been transferred is sent by the convey means 11 to the fixing device 12, where the developed image is fixed to the sheet P. After the fixing operation, when a one-face copy mode is selected, the sheet P is discharged to the sheet discharge portion 13. On the other hand, when a both-face copy mode or a multi-copy mode is selected, the sheet P is not discharged out of the apparatus, but is sent to the intermediate tray 15 by means of the re-supply sheet introduction portion 14. When a predetermined number of sheets are stacked on the intermediate tray 15, the sheets are separated and supplied one by one by the sheet re-supply portion 16, and each separated sheet is re-supplied to the transfer station in the image forming portion. Then, when a next original is introduced to the image forming portion by the original process device 9, the above-mentioned operations are repeated, and, after the fixing operation, each sheet is discharged onto the sheet discharge portion 13.

The developer and other adhered matter, such as paper powder, dust and the like, which are not transferred onto the sheet P by the transfer separation charger 4 during the image formation and remain on the image bearing member 1 are removed by the cleaning device 5. Then, the removed developer and other adhered matters (referred to as "foreign matter" hereinafter) are sent to a separating apparatus 17 which will be described later.

Figure 2:
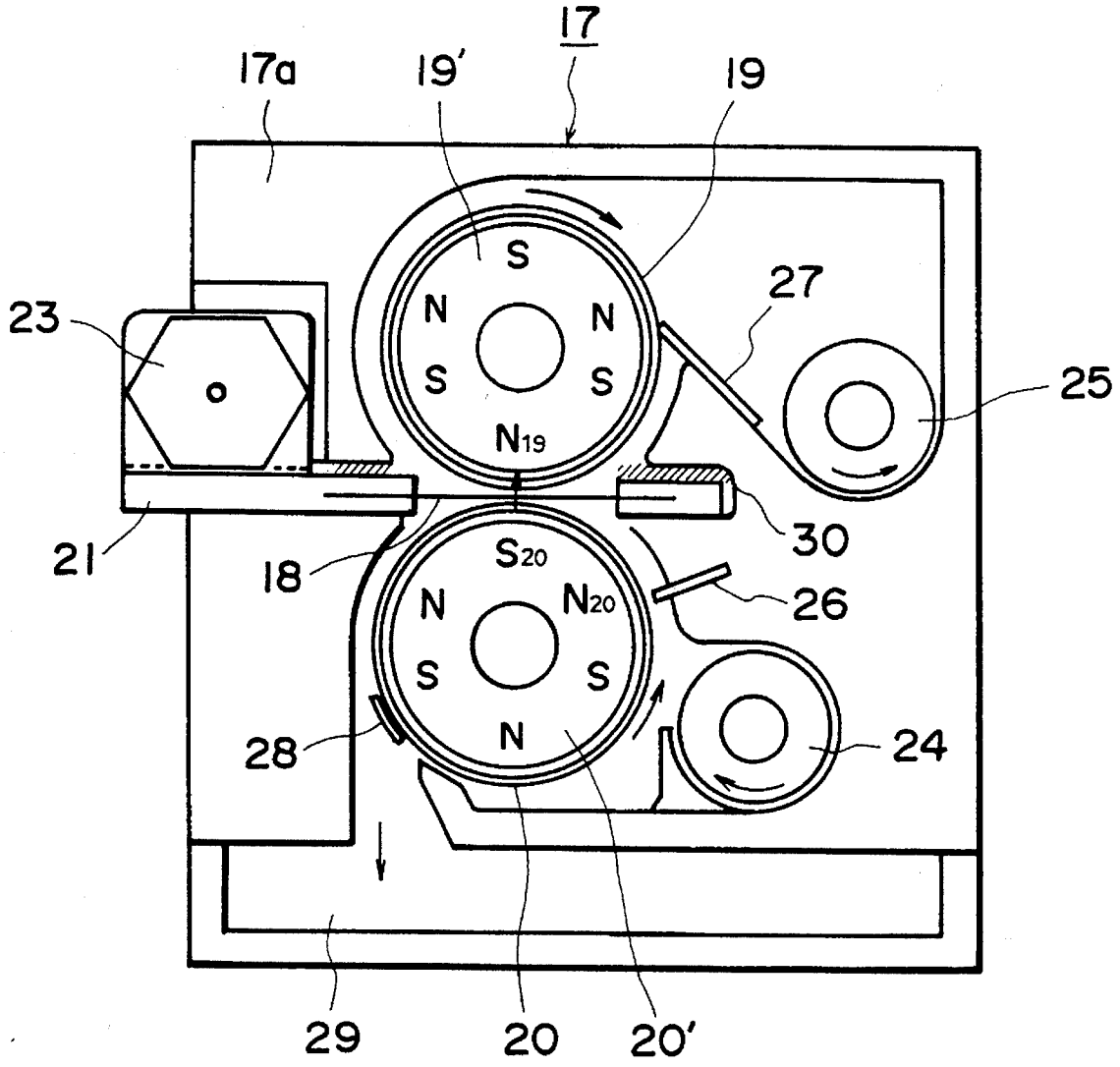
FIG. 2 is a sectional view of the separating apparatus according to the present invention.
Figure 3:
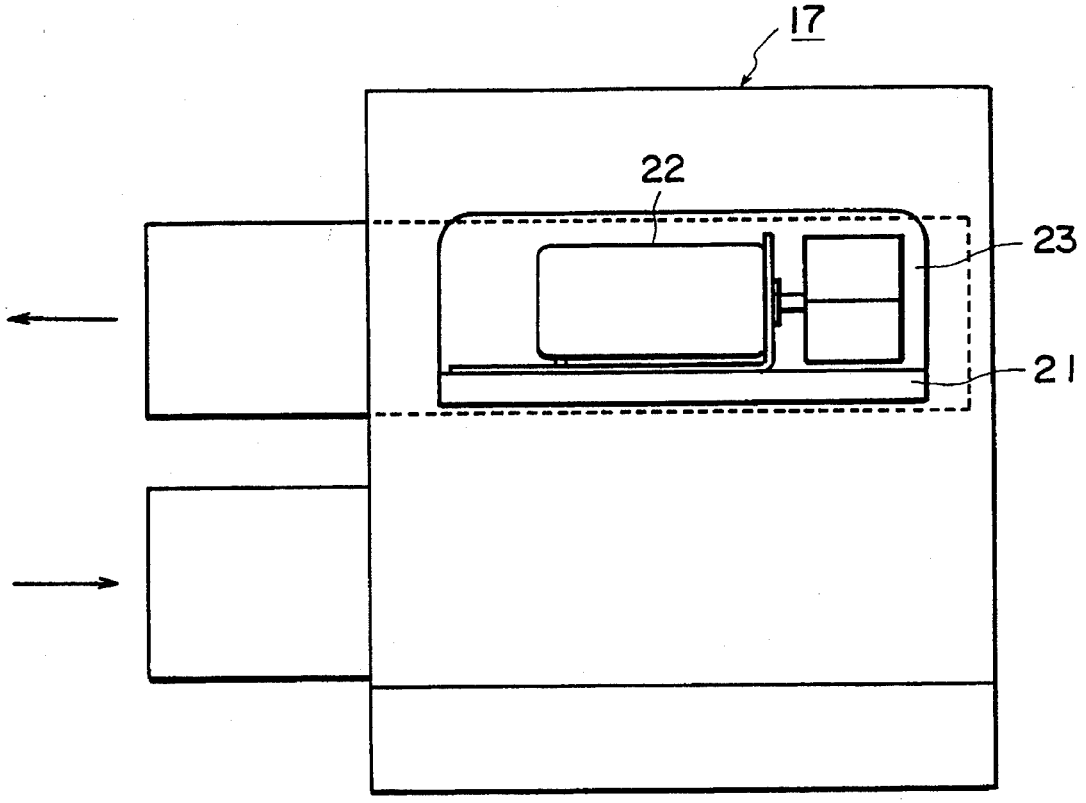
FIG. 3 is a side view of the separating apparatus according to the present invention.
Figure 4:
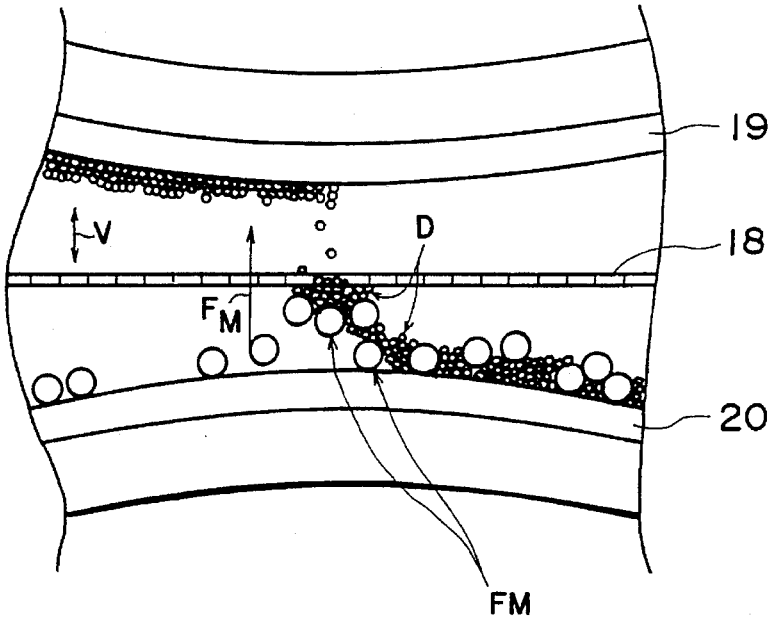
FIG. 4 is an explanatory view showing a condition wherein developer is separated from non-magnetic matters (foreign matters) by using the present separating apparatus.

Next, the separating apparatus will be explained with reference to FIGS. 2 to 4. FIG. 2 is a sectional view of the separating apparatus to which the present invention is applied, FIG. 3 is a side view of the separating apparatus, and FIG. 4 is an enlarged view showing a condition wherein developer is separated from non-magnetic matter (foreign matter) by the separating apparatus.

In FIG. 2, the separating apparatus 17 comprises a frame 17*a* in which a mesh 18, such as a net filter formed from non-magnetic material (for example, non-magnetic stainless steel wires, non-magnetic brass wires, or nylon fibers) is disposed substantially horizontally ($\alpha=0°$), and sleeves 19, 20 including non-rotatable magnets (magnetic field generating means) 19', 20' therein and rotated in directions shown by the arrows are arranged above and below the mesh 18. Incidentally, a relation between magnetic poles $N_{19}$ and $S_{20}$ on the sleeves 19, 20 at a separating station where the sleeves 19, 20 are opposed to each other with the interposition of the mesh 18 is selected to be $N_{19}>S_{20}$. Further, the mesh 18 is held by a support member 21 with which a cam 23 rotatingly driven by a drive motor 22 is contacted. Accordingly, the support member 21 is vibrated by the cam 23 rotated by the drive motor 22, thereby vibrating the mesh 18.

Further, there are provided convey screws 24, 25 for conveying developer. The convey screw 24 serves to convey developer and other foreign matter collected in the cleaning device 5 to the separating apparatus 17, and the convey screw 25 serves to re-supply developer to the developing device 2 (including the hopper portion 3). Further, there are also provided a doctor blade 26 for regulating a thickness of a layer of foreign matter on the sleeve 20, a scraper blade 27 for scraping developer adhered to the surface of the sleeve 19, a non-magnetic abutment member 28 for scraping non-magnetic matter adhered to the surface of the sleeve 20 into a collecting portion 29, and a seal member 30.

Next, a separating operation for separating developer from the foreign matter effected by the separating apparatus 17 will be explained.

First of all, developer and other foreign matter removed from the image bearing member 1 and collected in the cleaning device 5 are conveyed toward the sleeve 20 of the separating apparatus 17 by the convey screw 24. Then, the developer and other foreign matter are adhered on the surface of the sleeve 20 so that, as the sleeve 20 is rotated, they are conveyed upwardly. Meanwhile, the thickness of the layer on the sleeve 20 is regulated to a predetermined value by the doctor blade 26, and then, the developer and other foreign matter are sent to the separating station where the sleeves 19, 20 are opposed to each other with the interposition of the mesh 18.

As mentioned above, since the relation between the magnetic poles $N_{19}$ and $S_{20}$ on the sleeves 19, 20 at the separating station is selected to be $N_{19}>S_{20}$, developer and other foreign matter sent to the separating station where the sleeves 19, 20 are opposed to each other with the interposition of the mesh 18 by the sleeve 20 are effectively attracted by concentrated lines of magnetic force extending from the magnetic pole $S_{20}$ of the sleeve 20 to the magnetic pole $N_{19}$ of the sleeve 19, so that only developer is absorbed to the sleeve 19 through the mesh 18.

As shown in FIG. 4, since the mesh 18 has openings greater than a particle diameter of the developer by several times (preferably, openings of 150 μm (#100)–37.5 μm (#400), in an initial clean condition of the mesh, the developer can pass through the mesh smoothly. However, as the separating apparatus is operated continuously, partially aggregated developer adheres to the wires forming the mesh, or, under a high temperature condition, aggregation of the developer is promoted. Since aggregated developer blocks cannot pass through the openings of the mesh, the mesh is clogged or jammed with developer. However, in the illustrated embodiment of the present invention, since the mesh 18 is subjected to vibration (preferably, having a frequency of 50 Hz or more, and an amplitude of about 0.2–0.4 mm) under the action of the cam 23 driven by the drive motor 22, aggregation of the developer adhered to the mesh 18 is broken due to the vibration, thereby recovering or curing the clogging of the mesh to permit easy separation between the developer and the foreign matter. Further, since the weight of the developer itself is small, by setting the magnetic force at a value sufficient to create a conveying force greater than the weight of the developer, the developer can easily be conveyed upwardly to be adhered to the sleeve 19.

Further, in the illustrated embodiment, since the developer is conveyed upwardly in opposition to the gravity force of the developer, to separate the developer from the foreign matter, non-magnetic matter (foreign matter) separated from the developer is adhered to the under surface of the mesh 18. Accordingly, such foreign matter is separated from the mesh due to the vibration of the mesh and is dropped downwardly by its own weight. Thus, the developer can be separated from the foreign matter effectively, and the clogging of the mesh 18 can be prevented continually.

Further, developer separated from the foreign matter and adhered to the sleeve 19 is conveyed downstream as the sleeve 19 is rotated. Meanwhile, developer is scraped off of the sleeve 19 by the scraper blade 27, and the developer scraped off is conveyed out of the separating apparatus 17 by the convey screw 25. Then, the developer is conveyed to the developing device 2 (including the hopper portion 3) by convey means (not shown) to be reused in the image forming apparatus.

The foreign matter separated from the mesh at the separating station drops onto the sleeve 20 and is further conveyed together with developer remaining on the sleeve 20. Then, the foreign matter is removed from the sleeve 20 by the non-magnetic abutment member 28. That is to say, since the non-magnetic abutment member 28 is abutted against the sleeve 20 with a weak abutting force, the foreign matter adhered to the sleeve with a weak force can be scraped from sleeve. However, developer which was not separated at the separating station and remaining on the sleeve 20 is adhered to the sleeve by the magnetic force, such residual developer cannot be scraped by the non-magnetic abutment member 28, but is further conveyed downwardly for the next separation. Thus, almost all of the developer is not collected in the collecting portion, and only the non-magnetic foreign matter is collected in the collecting portion.

As mentioned above, by breaking the aggregation of the developer and by dropping the foreign matter from the mesh downwardly under the action of the vibration of the mesh, clogging of the mesh is prevented to permit effective and continuous separation between the developer and the foreign matter for a long time.

Figure 6A:
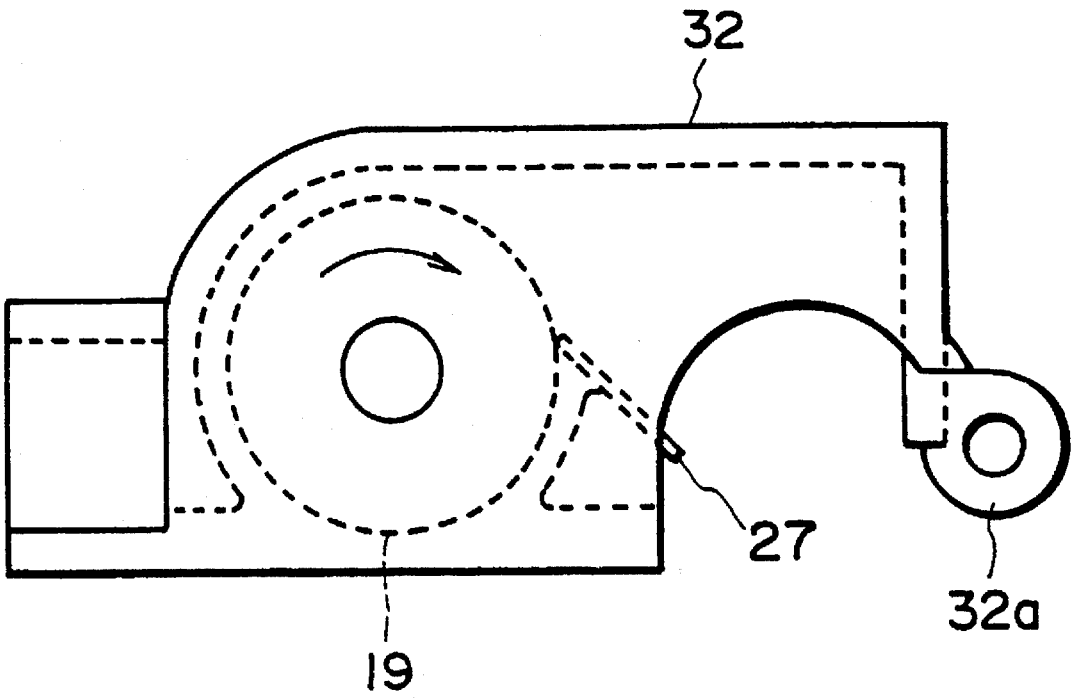
Figure 6B:
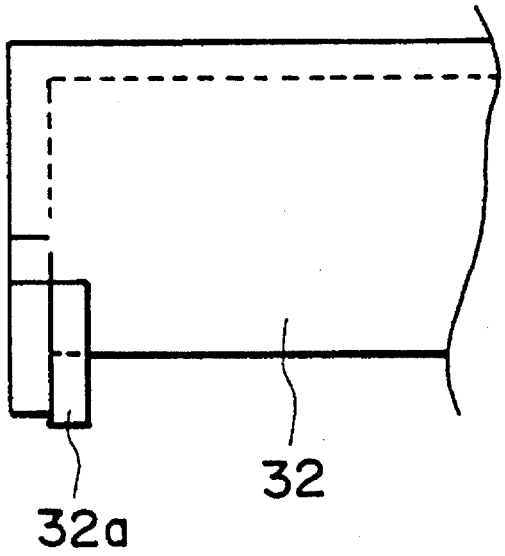
Figure 7A:
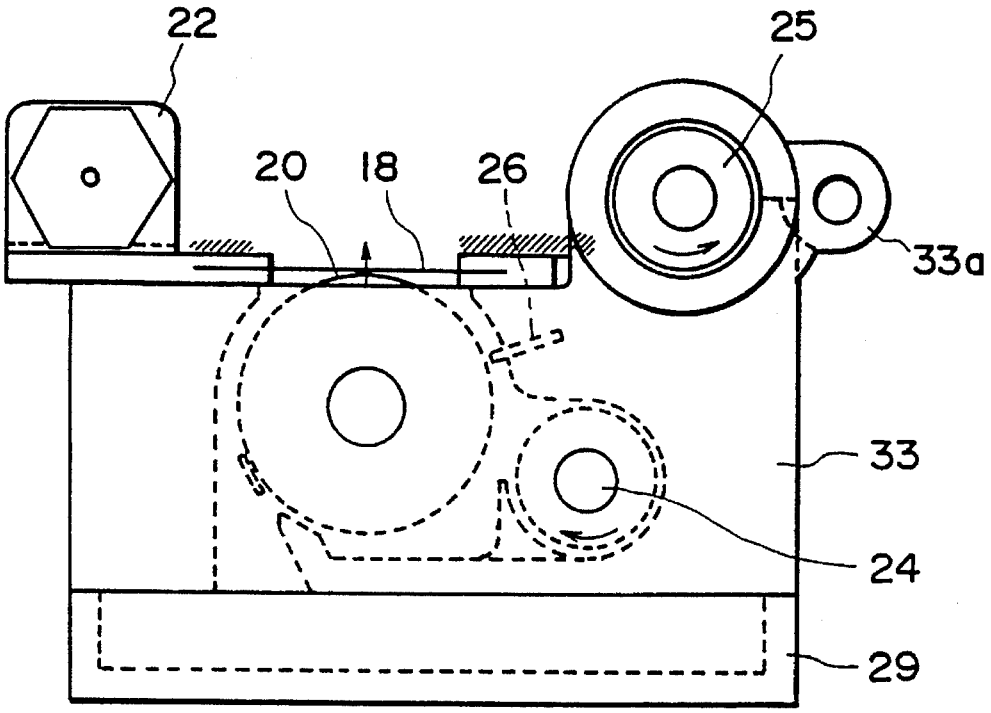
Figure 7B:
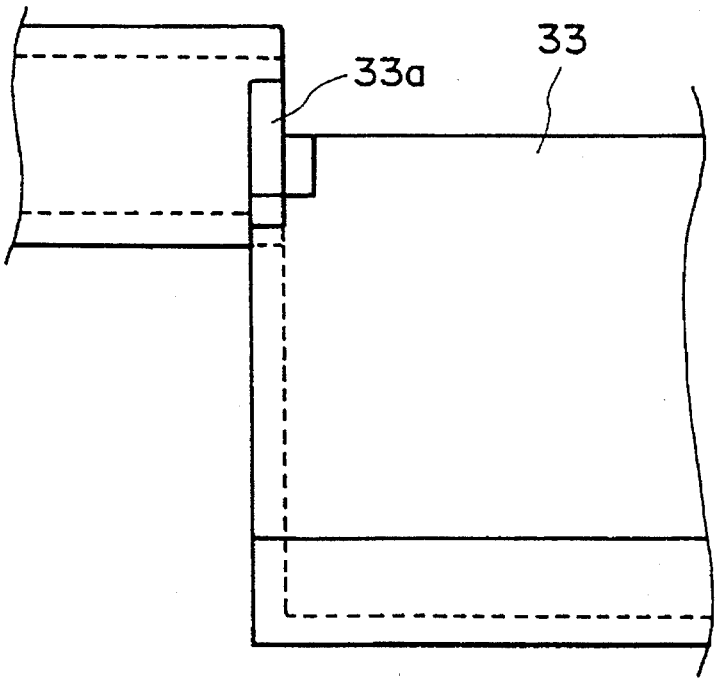

Further, in the separating apparatus according to the present invention, the sleeves 19, 20 can be spaced apart from each other to prevent clogging of the mesh and malfunction of the apparatus due to the mixing of metal pieces with the developer. Now, such an arrangement will be fully explained with reference to FIGS. 5 to 7.

Figure 5:
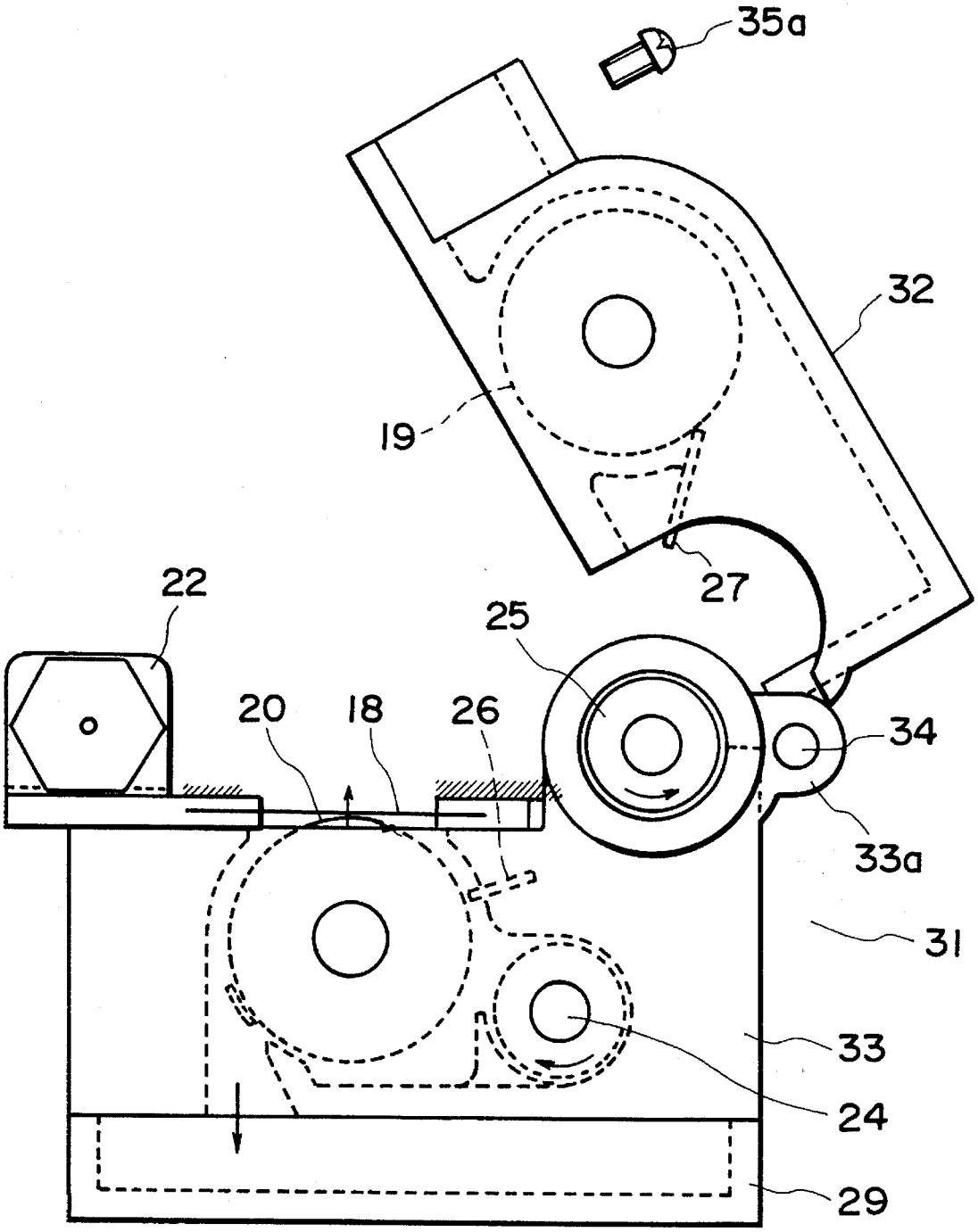
FIGS. 5 to 7 are views showing a condition wherein an upper sleeve is separated from a lower sleeve in the present separating apparatus.
Figure 8:
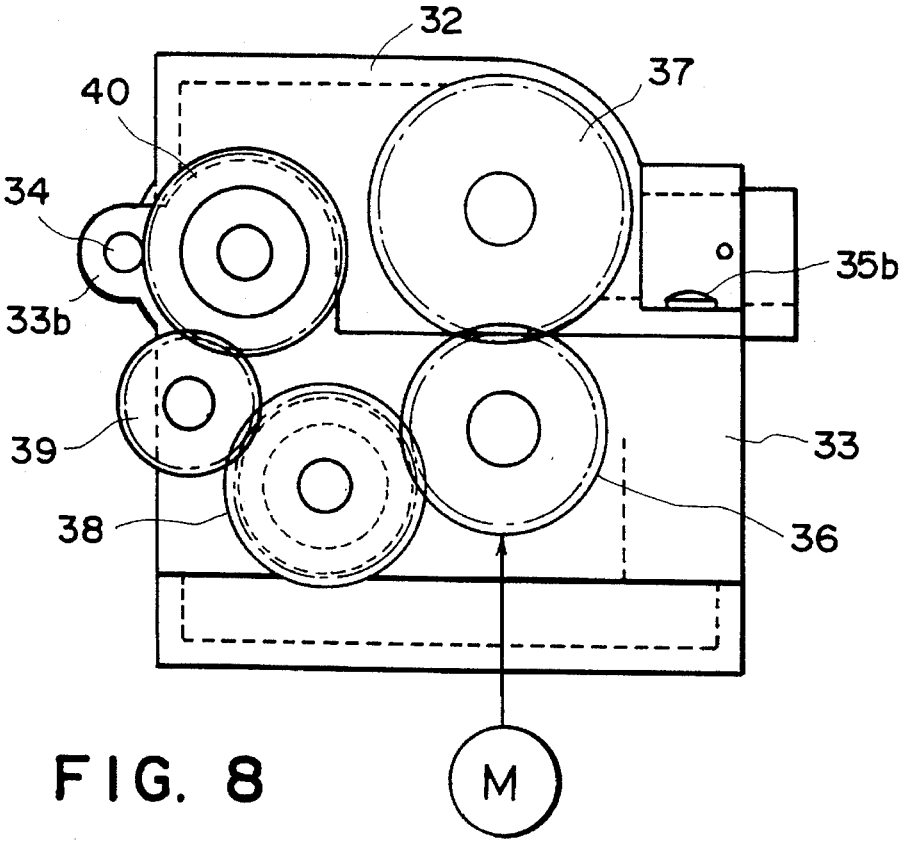
FIGS. 8 to 10 are views showing a driving system of the present separating apparatus.
Figure 10:
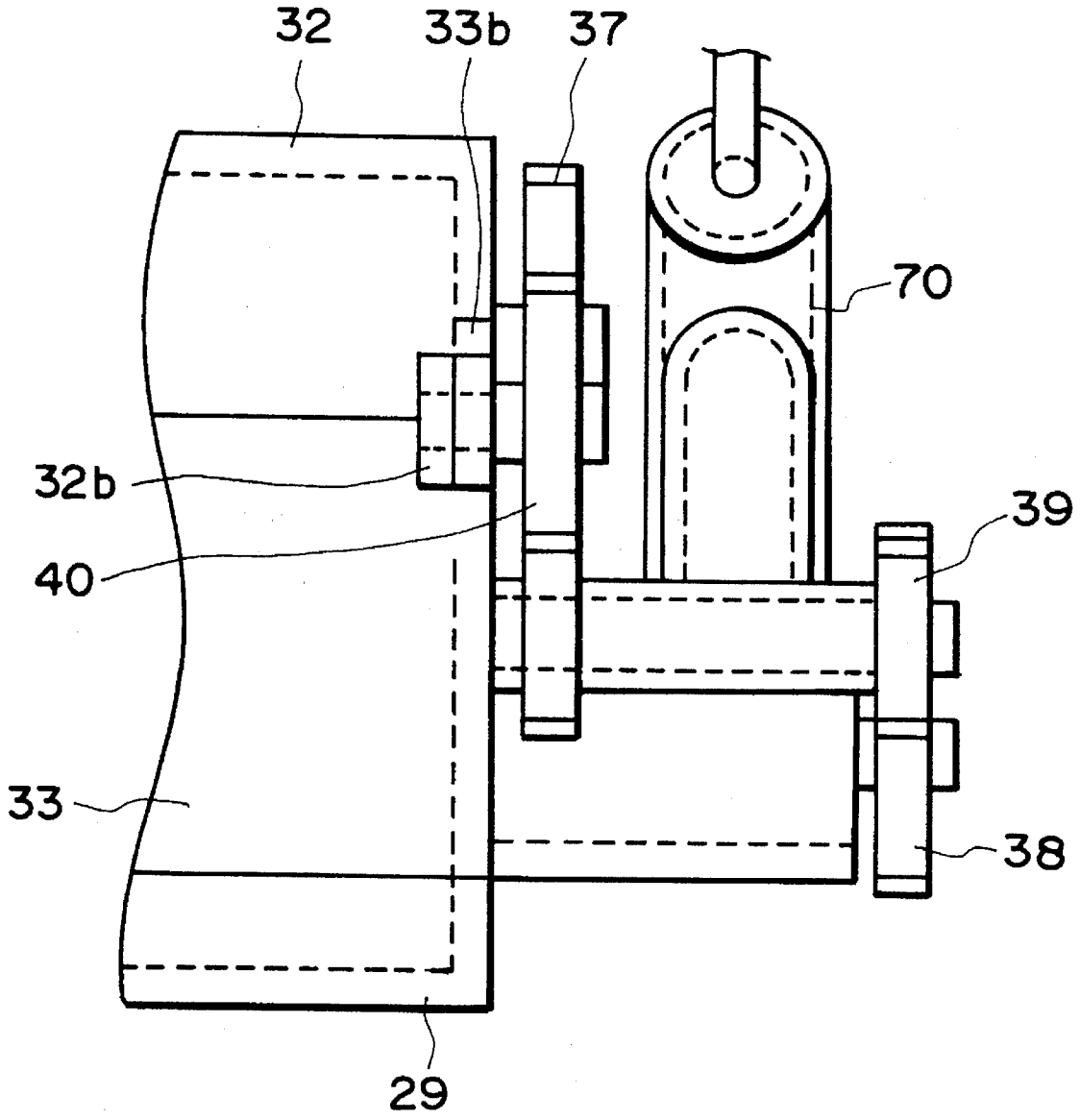

In FIG. 5, a separating apparatus 31 comprises an upper frame 32 and a lower frame 33 which are provided with hinge arms 32*a*, 32*b* (FIG. 10) at this side and hinge arms 33*a*, 33*b* (FIG. 10) at that side, so that, by inserting pins 34 into holes formed in the hinge arms, the upper and lower frames 32, 33 can be rocked around the pins 34 upwardly and downwardly, respectively. Further, when the upper and lower frames 32, 33 are closed, these frames are secured to each other by screws 35*a*, 35*b* (FIGS. 5 and 8). The sleeve 19 and the blade 27 are supported by the upper frame 32, and the sleeve 20, doctor blade 26, convey screws 24, 25, mesh 18 and drive motor 22 are supported by the lower frame 33. Further, the lower frame is provided with the collecting portion 29.

Now, the drive arrangement will be explained with reference to FIG. 8.

A gear 36 is secured to an end shaft of the sleeve 20 and is driven by a drive source M. A gear 37 secured to an end shaft of the sleeve 19 is meshed with the gear 36 and a gear 38 secured to an end shaft of the convey screw 24 is also meshed with the gear 36. Further, a gear 40 secured to an end shaft of the convey screw 25 is connected to the gear 38 via an idler gear 39 to transmit a driving force from the gear 38 to the gear 40.

Figure 13:
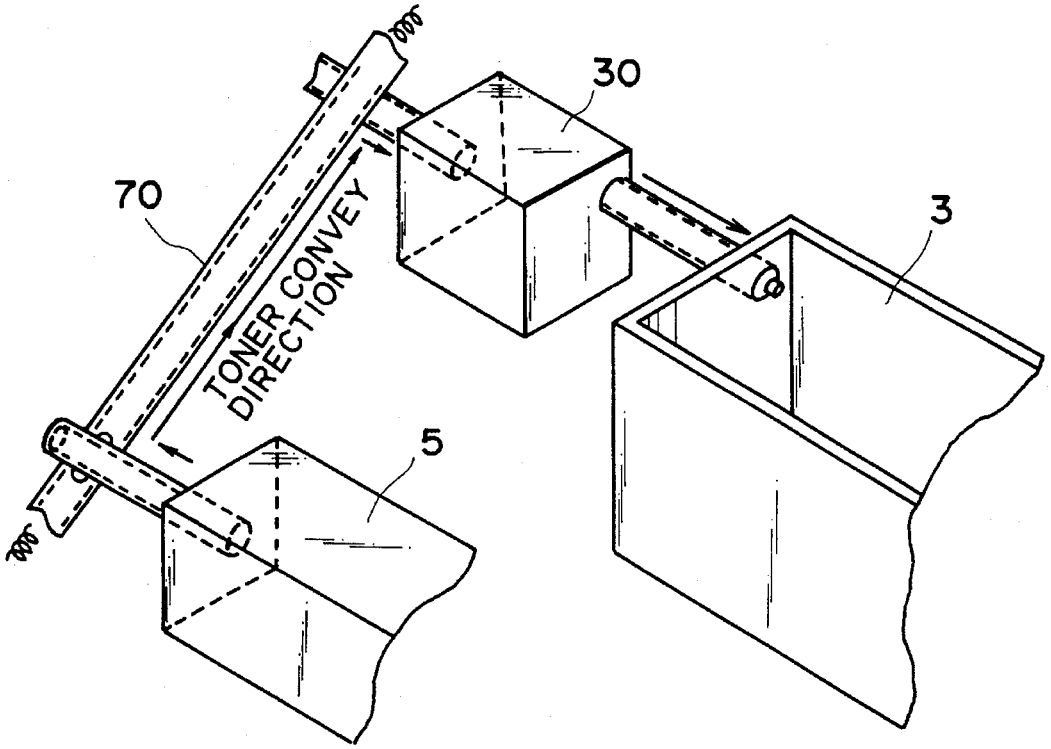
FIG. 13 is a schematic enlarged perspective view showing a conveying path for conveying developer removed from an image bearing member.

Further, as shown in FIG. 13 which is a schematic enlarged perspective view showing a conveying path for conveying developer removed from the image bearing member, the developer and other foreign matter (paper powder and the like) removed from the image bearing member are sent from the cleaning device 5 to a convey pipe 70 having a convey screw therein. The developer and other foreign matter (paper powder and the like) entered into the convey pipe 70 are sent to a separating apparatus 30 having the above-mentioned construction. Further, developer separated from the foreign matter such as paper powder and the like in the separating apparatus 30 is sent to the hopper portion 3. Thereafter, the developer is supplied to the developing device 2 to be used in the image formation again.

Figure 9:
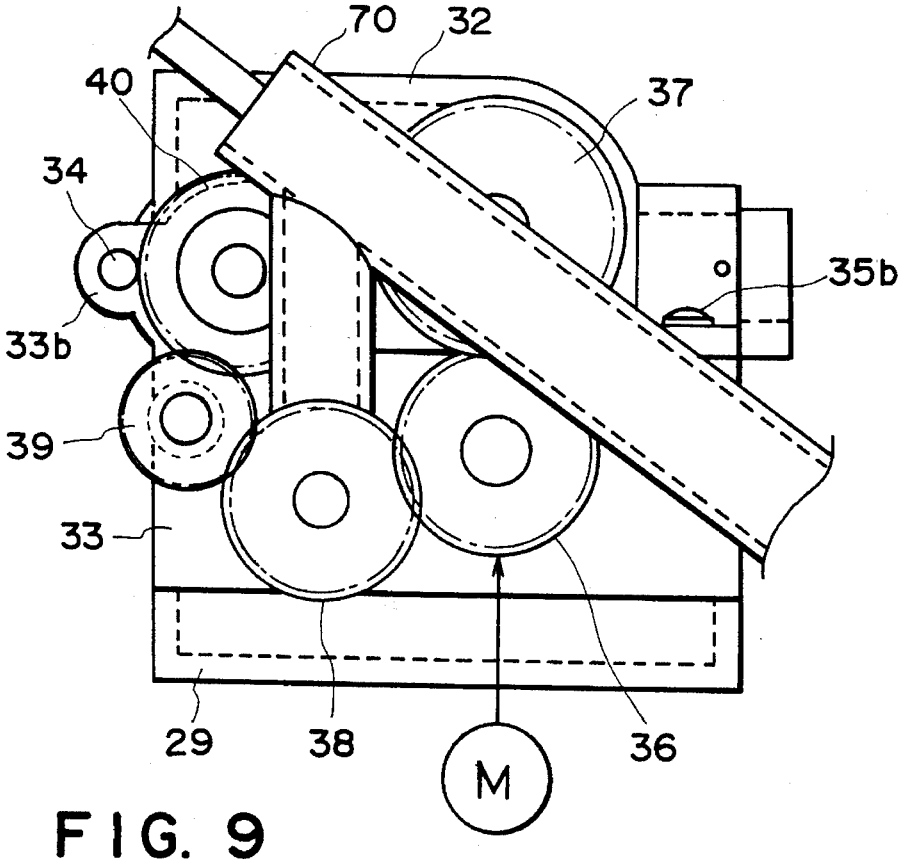

FIG. 9 shows a positional relation between the convey pipe 70 and the drive system. With the arrangement as mentioned above, when the upper frame 32 is opened with respect to the lower frame 33 as shown in FIG. 5, the gear 37 of the sleeve 19 is disengaged from the gear 36 of the sleeve 20; whereas, when the upper frame 32 is closed with respect to the lower frame 33, the gear 37 is engaged by the gear 36. In this case, in order to ensure a backlash between the gears 36, 37, a position of one of the sleeves 19, 20 may be adjustable in the frame to obtain the predetermined backlash. Alternatively, in place of such adjustment, the profiles of the gears may be shifted negatively to prevent wear of the gear.

With the above-mentioned arrangment, by separating the sleeves 19, 20 from each other, periodical maintenance for curing clogging of the mesh, which might be caused due to long-run use of the mesh and/or the fusing of developer onto the sleeves, can be performed easily, and foreign matter entered into the separating apparatus can easily be removed.

Further, in the illustrated embodiment, since the convey screws 24, 25 are supported by the lower stationary frame 33, it is not required to disengage or release the connection between the convey pipe 70 and the separating apparatus and the connection between the separating apparatus and the hopper portion 3 as shown in FIG. 13, thereby further facilitating maintenance.

Second Embodiment

Next, a separating apparatus according to a second embodiment of the present invention will be explained with reference to FIGS. 11A and 11B, which are sectional views of the separating apparatus. Incidentally, the same functional and constructional elements as those of the first embodiment are designated by the same reference numerals and explanation thereof will be omitted.

Figure 11A:
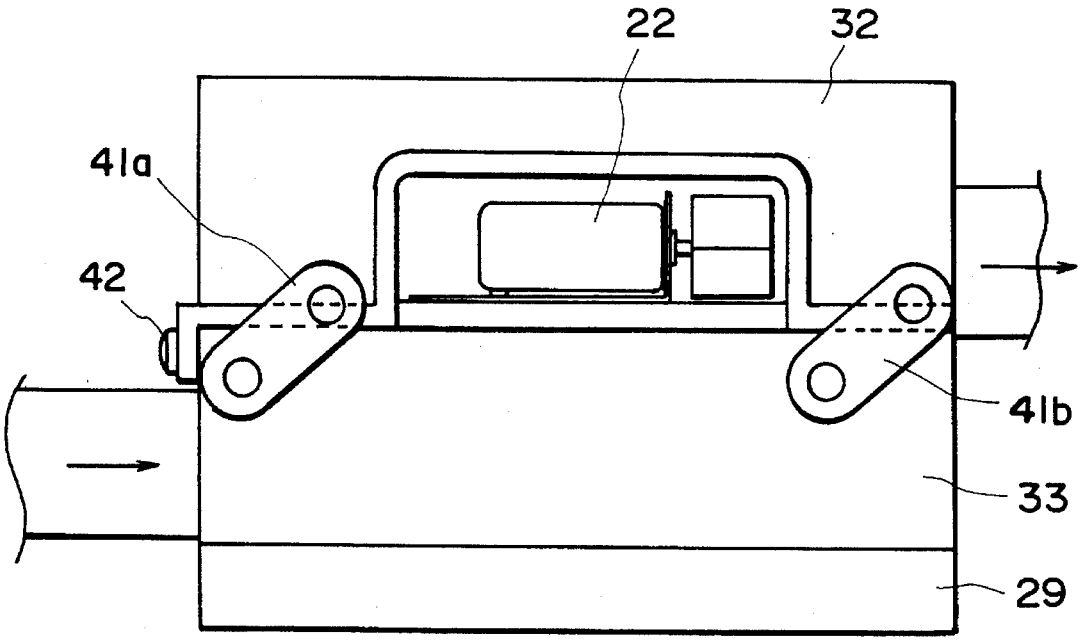
FIGS. 11A and 11B are views showing a second embodiment of the present invention.
Figure 11B:
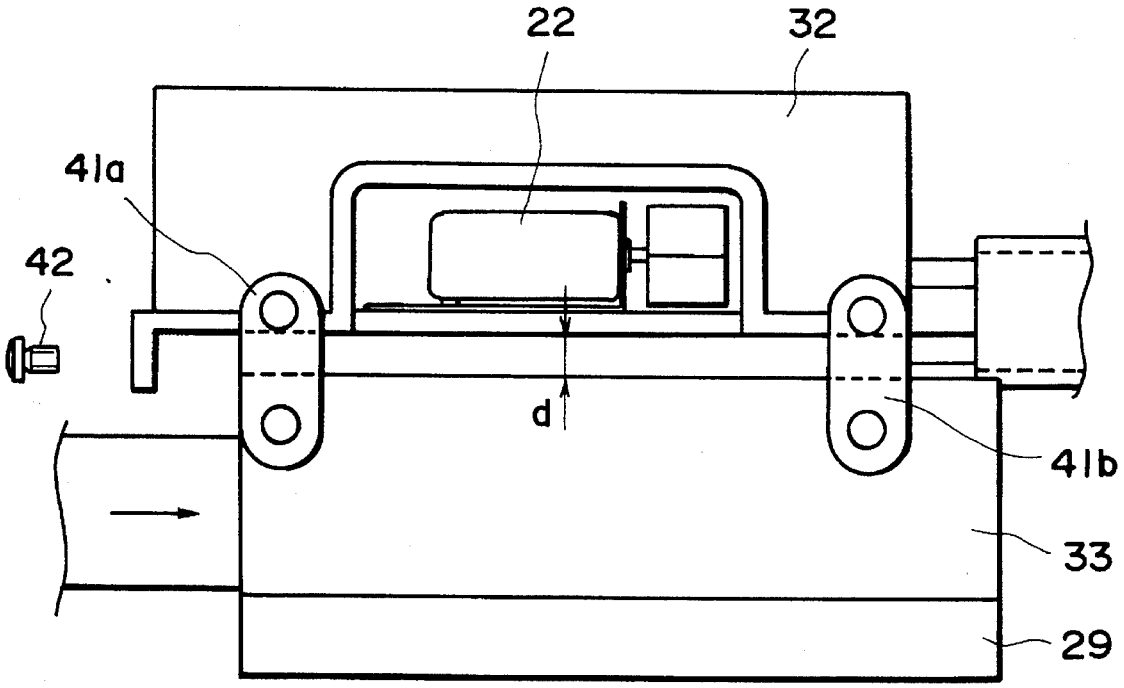

In FIGS. 11A and 11B, the upper frame 32 and the lower frame 33 are connected to each other through four parallel link members 41*a*, 41*b* and 41*c*, 41*d* (not shown). When the upper frame is closed, as shown in FIG. 11A, the upper frame is secured to the lower frame by screws 42. When maintenance is required, the screws 42 are removed, and, as shown in FIG. 11B, a gap d is created between the upper frame and the lower frame under the action of the link members 41*a*–41*d*, thereby facilitating maintenance as is in the aforementioned embodiment.

This embodiment is suitable for any copying machine wherein there is no adequate space for opening the upper frame upwardly, unlike the first embodiment (FIG. 5), and contributes to the compactness of the image forming apparatus.

Third Embodiment

Next, an image forming apparatus according to a third embodiment of the present invention will be explained with reference to FIGS. 12A and 12B. Incidentally, since the operations and constructions of the image forming apparatus and a separating apparatus incorporated into the image forming apparatus are the same as those of the above-mentioned embodiments, detailed explanation thereof will be omitted. Further, the same functional elements as those of the above-mentioned embodiments are designated by the same reference numerals.

Figure 12A:
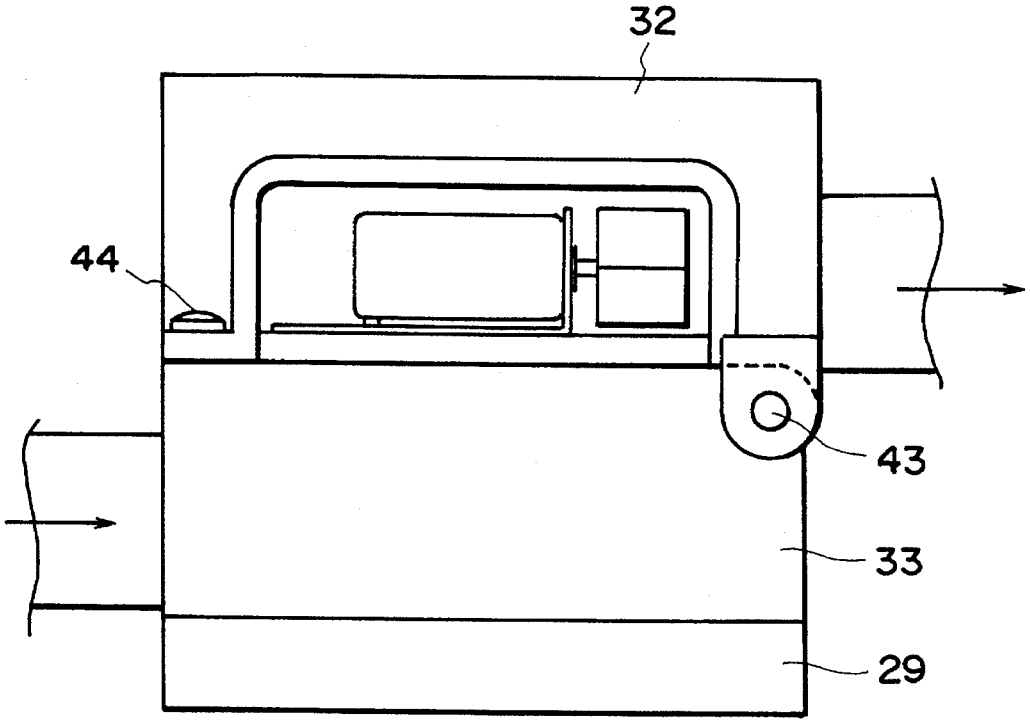
FIGS. 12A and 12B are views showing a third embodiment of the present invention.
Figure 12B:
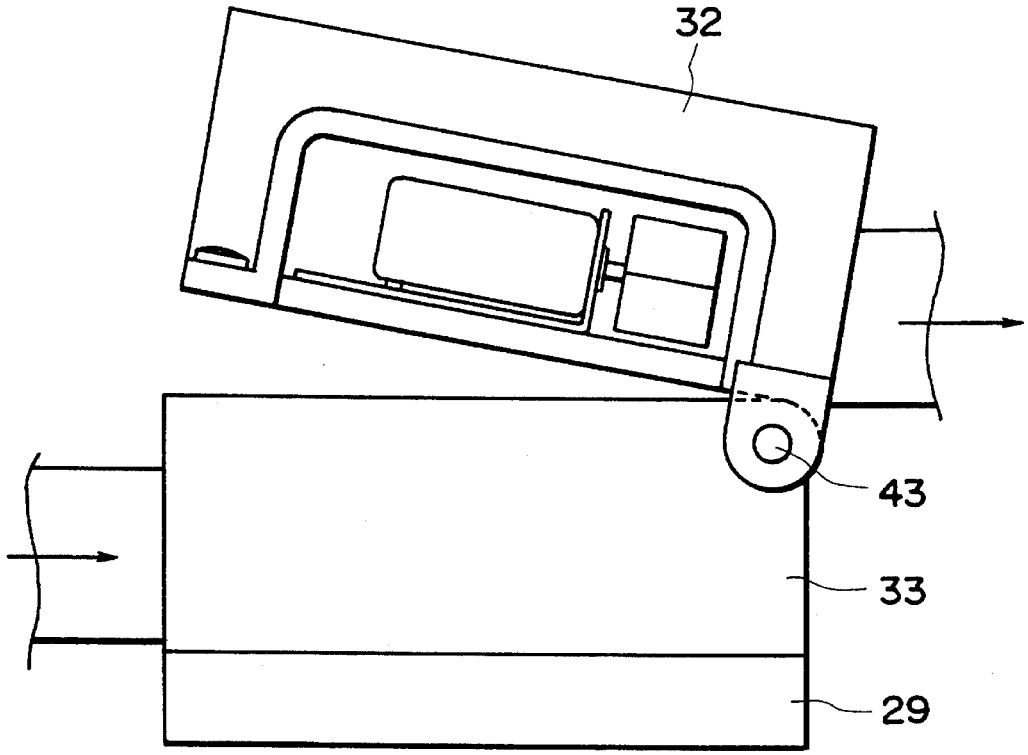

In FIGS. 12A and 12B, the upper frame 32 and the lower frame 33 can be rocked with respect to each other around hinge portions 43 disposed at the right end of the frames. When the upper frame is closed (FIG. 12A), the frames are secured to each other by screws 44. FIG. 12B shows a condition wherein the upper frame 32 is opened with respect to the lower frame 33. Also with this arrangement, the objects of the present invention can be achieved.

In the above-mentioned embodiments while an example wherein the mesh 18 and the drive motor 22 are supported by the lower frame 33 and a pinching fashion or screw-securing fashion was explained, the mesh and the drive motor may be supported by the upper frame. In this case, the same technical effect can be achieved. Further, in the above-mentioned embodiments, while the convey screw 25 was supported by the lower frame, the convey screw 25 may be supported by the upper frame. In this case, however, it should be noted that the convey screw 25 and a pipe portion thereof should be shiftable at a connecting portion between the convey screw 25 and the hopper portion 3 when the upper frame is opened and closed.

Figure 14:
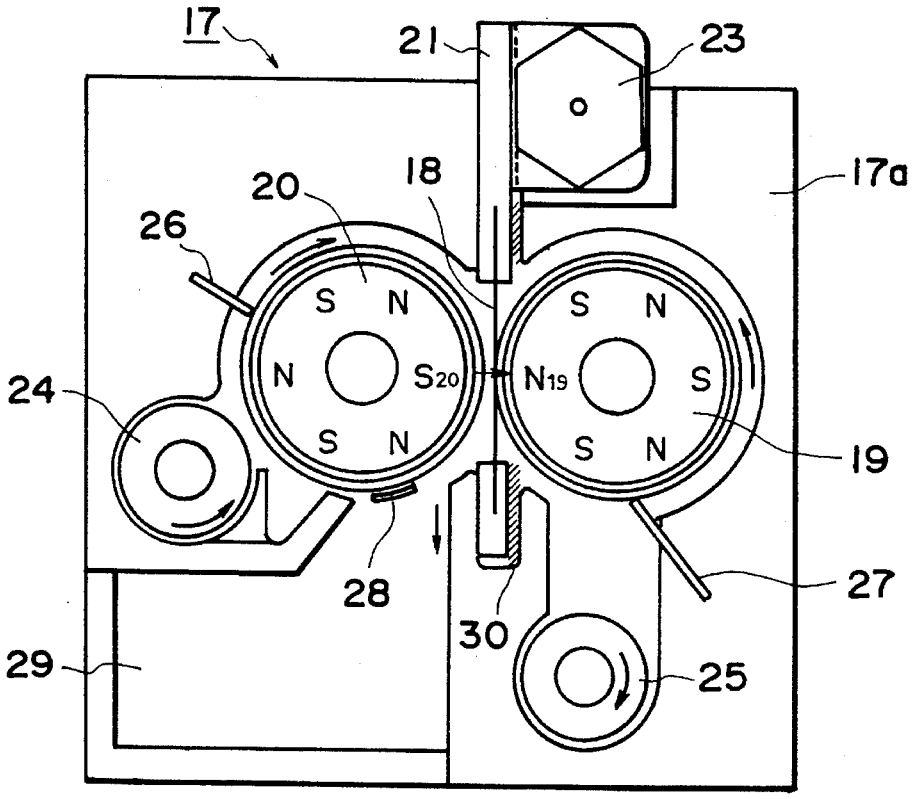
FIG. 14 is a sectional view of a separating apparatus according to an alternative embodiment.

Further, as shown in FIG. 14, the present invention can be applied to a separating apparatus wherein a mesh (net filter) 18 is arranged substantially vertically and sleeves 19, 20 including magnets (magnetic field generating means) therein are disposed on both sides of the mesh in a confronting relation.

Furthermore, in the above-mentioned embodiments, it is more preferable that a seal member such as a molt plane is provided to surround the interface between the upper frame 32 and the lower frame 33, thereby preventing the developer from leaking from the separating apparatus.

As mentioned above, since two magnetic field generating means are separably arranged on both sides of the mesh filter in a confronting relation, in the separating apparatus, if the mesh is clogged due to aggregated or solidified developer and/or non-magnetic foreign matter such as paper powder which cannot be removed by the magnetic force are trapped and/or if foreign matter such as a metal piece is entered into the separating apparatus, since maintenance can easily be performed, such inconvenience can easily be eliminated.

Further, the separation between the upper frame and the lower frame is not limited to the above-mentioned embodiments. For example, these frames may be merely separated in an up-and-down direction without using any hinges or link mechanism, and may be secured to each other by a conventional fastening member or members such as screws. In any case, by disposing the mesh between the upper frame and the lower frame, maintenance regarding the mesh and the sleeves can be improved remarkably.

In addition, in the above-mentioned embodiments, the upper frame may be stationary and the lower frame may be shifted with respect to the upper frame, so long as the upper and lower frame can be shifted relatively.

As mentioned above, the present invention is not limited to the above-mentioned embodiments, and various alterations and modifications can be effected within the scope of the present invention.

What is claimed is:

1. A separating apparatus for separating residual matter removed from an image bearing member into developer and other foreign matter, comprising:

a first unit to which residual matter removed from said image bearing member is conveyed;

a mesh member for allowing only developer contained in said residual matter to pass therethrough;

vibration applying means for applying vibration to said mesh member; and a second unit for receiving developer conveyed from said first unit through said mesh member;

wherein said first unit and said second unit are separable from each other with said mesh member disposable therebetween.

2. A separating apparatus for separating residual matter removed from an image bearing member into developer and other foreign matter, comprising:

a first unit to which residual matter removed from said image bearing member is conveyed;

a mesh member for allowing only developer contained in said residual matter to pass therethrough;

a second unit for receiving developer conveyed from said first unit through said mesh member;

first magnetic force generating means provided in said first unit; and second magnetic force generating means provided in said second unit;

wherein said first unit and said second unit are separable from each other with said mesh member disposable therebetween.

3. A separating apparatus according to claim 2, wherein said second magnetic force generating means is disposed above said first magnetic force generating means in a vertical direction.

4. A separating apparatus according to claim 2, wherein a magnetic force generated by said second magnetic force generating means is greater than a magnetic force generated by said first magnetic force generating means at a position of said mesh member.

5. A separating apparatus according to claim 4, wherein said second magnetic force generating means is disposed above said first magnetic force generating means in a vertical direction.

6. A separating apparatus according to claim 2, wherein said first magnetic force generating means conveys the residual matter to said mesh member, and said second magnetic force generating means conveys developer through said mesh member.

7. A separating apparatus according to claim 6, wherein said second magnetic force generating means is disposed above said first magnetic force generating means in a vertical direction.

8. A separating apparatus according to claim 6, wherein a magnetic force generated by said second magnetic force generating means is greater than a magnetic force generated by said first magnetic force generating means at a position of said mesh member.

9. A separating apparatus according to claim 8, wherein said second magnetic force generating means is disposed above said first magnetic force generating means in a vertical direction.

10. A separating apparatus for separating residual matter removed from an image bearing member into developer and other foreign matter, comprising:

a first unit to which residual matter removed from said image bearing member is conveyed;

convey means supported by said first unit, for conveying residual matter to said first unit;

a mesh member for allowing only developer contained in said residual matter to pass therethrough;

a second unit for receiving developer conveyed from said first unit through said mesh member; and discharge means, supported by said first unit, for discharging developer from said second unit;

wherein said first unit and said second unit are separable from each other with said mesh member disposable therebetween.

11. A separating apparatus for supporting residual matter removed from an image bearing member into developer and other foreign matter, comprising:

a first unit to which residual matter removed from said image bearing member is conveyed;

convey means for conveying residual matter to said first unit;

a mesh member for allowing only developer contained in said residual matter to pass therethrough;

a second unit for receiving developer conveyed from said first unit through said mesh member; and discharge means for discharging developer from said second unit;

wherein said first unit and said second unit are separable from each other with said mesh member disposable therebetween, and wherein said convey means and said discharge means are stationary during opening and closing movement between said first unit and said second unit.

12. An image forming apparatus comprising:

an image bearing member;

developing means for developing said image bearing member with a developer;

cleaning means for removing residual matter from said image bearing member; and a separating apparatus for separating residual matter into developer and other foreign matter;

wherein said separating apparatus comprises a first unit to which residual matter is conveyed, convey means, supported by said first unit, for conveying residual matter to said first unit, a mesh member for allowing only developer contained in said residual matter to pass therethrough, a second unit for receiving developer conveyed from said first unit through said mesh member, and discharge means, supported by said first unit, for discharging developer from said second unit, said first unit and said second unit being separable from each other with said mesh member disposable therebetween.

13. An image forming apparatus comprising:

an image bearing member;

developing means for developing said image bearing member with a developer;

cleaning means for removing residual matter from said image bearing member; and a separating apparatus for separating residual matter into developer and other foreign matter;

wherein said separating apparatus comprises a first unit to which residual matter is conveyed, convey means for conveying residual matter to said first unit, a mesh member for allowing only developer contained in said residual matters to pass therethrough, a second unit for receiving developer conveyed from said first unit through said mesh member, and discharge means for discharging developer from said second unit, said first unit and said second unit being separable from each other with said mesh member disposable therebetween, and said convey means and said discharge means being stationary during relative opening and closing movement between said first unit and said second unit.

* * * * *

UNITED STATES PATENT AND TRADEMARK OFFICE

CERTIFICATE OF CORRECTION

PATENT NO. : 5,512,994

DATED : April 30, 1996

INVENTOR(S) : MICHIRO KOIKE

It is certified that error appears in the above-indentified patent and that said Letters Patent is hereby corrected as shown below:

COLUMN 9:

Line 6, "supporting" should read --separating--.

COLUMN 10:

Line 24, "matters" should read --matter--.

Signed and Sealed this

Sixth Day of August, 1996

*Attest:*

*Attesting Officer*

BRUCE LEHMAN

*Commissioner of Patents and Trademarks*